US005082423A

United States Patent [19]

Morgan

[11] Patent Number: 5,082,423

[45] Date of Patent: Jan. 21, 1992

[54] PADDLEWHEEL APPARATUS

[76] Inventor: Bruce S. Morgan, Embassy Park, 3188 Lake Shore Dr., Pembroke Park, Fla. 33009

[21] Appl. No.: 549,952

[22] Filed: Jul. 9, 1990

[51] Int. Cl.[5] ..... B63H 1/10

[52] U.S. Cl. ..... 416/111; 415/124.1; 415/141

[58] Field of Search ..... 416/9, 111, 170 R; 440/90, 92; 415/122.1, 124.1, 140, 141

[56] References Cited

U.S. PATENT DOCUMENTS

| | | | |
|---|---|---|---|
| 583,171 | 5/1897 | Curry . | |
| 957,099 | 5/1910 | Robinson | 416/111 |
| 1,540,257 | 6/1925 | Doehlert, Jr. . | |
| 1,636,423 | 7/1927 | Langenbach | 416/111 |
| 1,708,475 | 4/1929 | Krodel | 416/111 |
| 1,811,031 | 6/1931 | Smith et al. | 416/111 |
| 2,036,727 | 4/1936 | Stow . | |
| 2,258,699 | 10/1941 | Calvo-Mackenna | 415/141 |
| 3,027,863 | 4/1962 | Town . | |
| 3,131,772 | 5/1964 | Town . | |
| 3,915,586 | 10/1975 | Gassie . | |

FOREIGN PATENT DOCUMENTS

| | | | |
|---|---|---|---|
| 26485 | 11/1906 | Fed. Rep. of Germany | 440/93 |

*Primary Examiner*—Edward K. Look
*Assistant Examiner*—James A. Larson
*Attorney, Agent, or Firm*—Oltman and Flynn

[57] ABSTRACT

This invention is a paddlewheel apparatus having epicyclic gear trains in rotatable holders at opposite ends of a plurality of paddles. The paddles are maintained substantially vertical throughout the rotation of the holders and they are completely unobstructed by any other part of the apparatus in all phases of operation. A housing which extends over the holders and the paddles is open at the bottom to pass the downwardly hanging paddles into the water.

16 Claims, 7 Drawing Sheets

FIG. 10
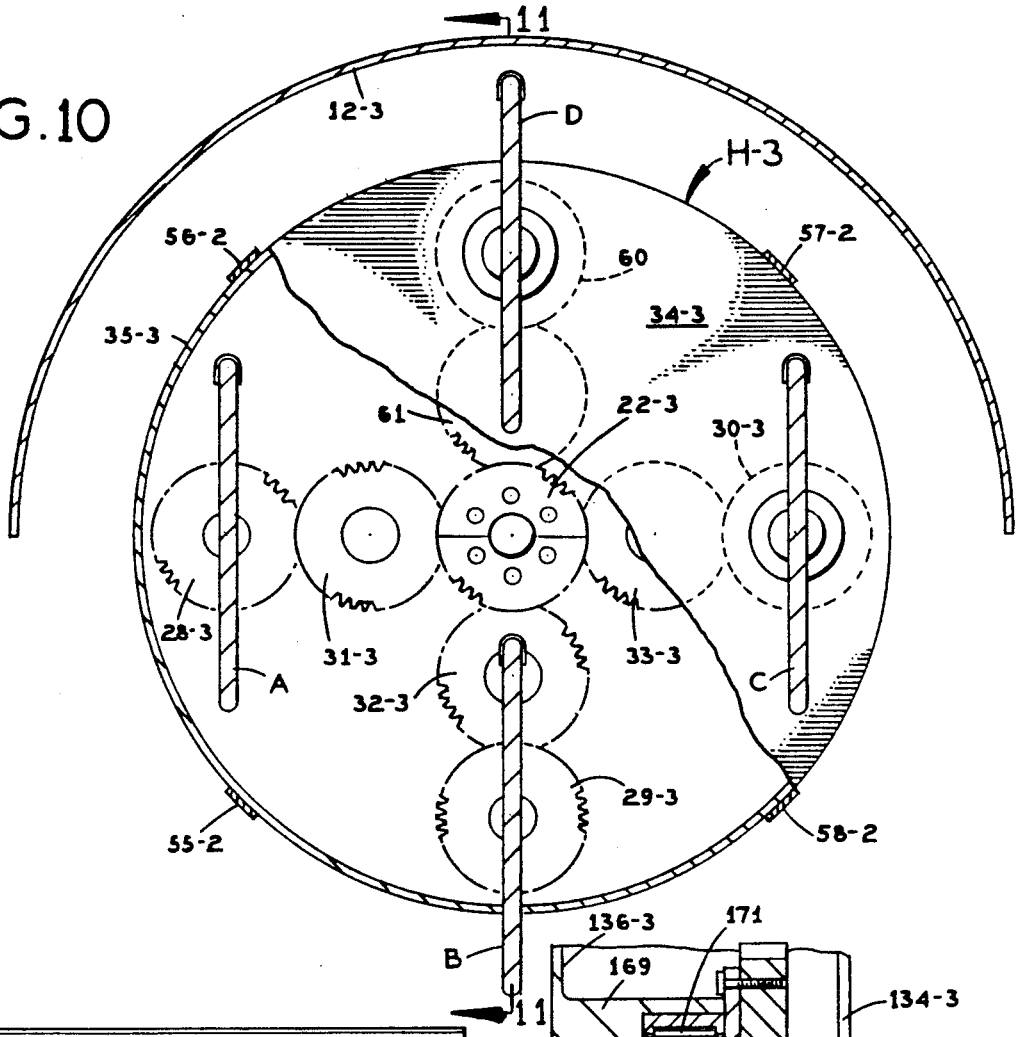
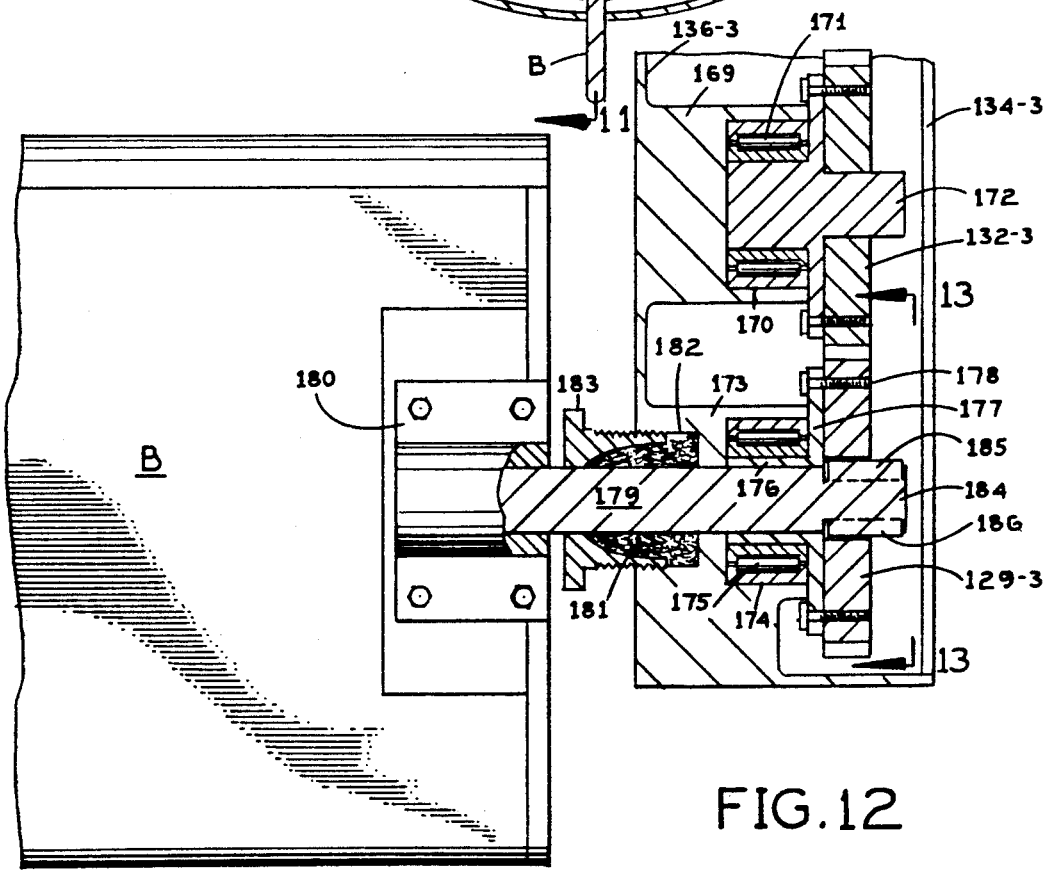
FIG. 12

PADDLEWHEEL APPARATUS

SUMMARY OF THE INVENTION

This invention relates to a paddlewheel apparatus of the type in which the paddles are maintained substantially at a predetermined angle, preferably vertical, throughout the rotation of the paddlewheel.

A principal object of this invention is to provide such a paddlewheel apparatus in which the paddles are completely unobstructed below by any other part of the apparatus, thereby enabling the use of paddles which are longer vertically and can dip farther into the water.

Further objects and advantages of this invention will be apparent from the following detailed description of three presently preferred embodiments which are illustrated schematically in the accompanying drawings.

Preferably, the paddlewheel apparatus according to this invention has fixed, coaxial, non-rotatable sun gears at its opposite ends, each part of a respective epicyclic gear train having idler gears engaged between the sun gear and respective planet gears. Each epicyclic gear train is in a corresponding holder which is rotatable on the axis of the sun gears and rotatably supports the idler and planet gears of that gear train. Paddles are coupled at opposite ends to respective planet gears of each epicyclic gear train. Between the rotatable holders the paddles are completely unobstructed below by any other part of the paddlewheel apparatus. The gear trains maintain the paddles substantially vertical throughout each rotation of the holders.

DESCRIPTION OF THE DRAWINGS

FIG. 10 is a view like FIG. 5 but showing a third embodiment of the present paddlewheel apparatus;

FIG. 12 is an enlarged fragmentary vertical section showing the lost-motion coupling between one paddle and the corresponding planet gear in the epicyclic gear train at one end;

Before explaining the disclosed embodiments of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

Figure 1:
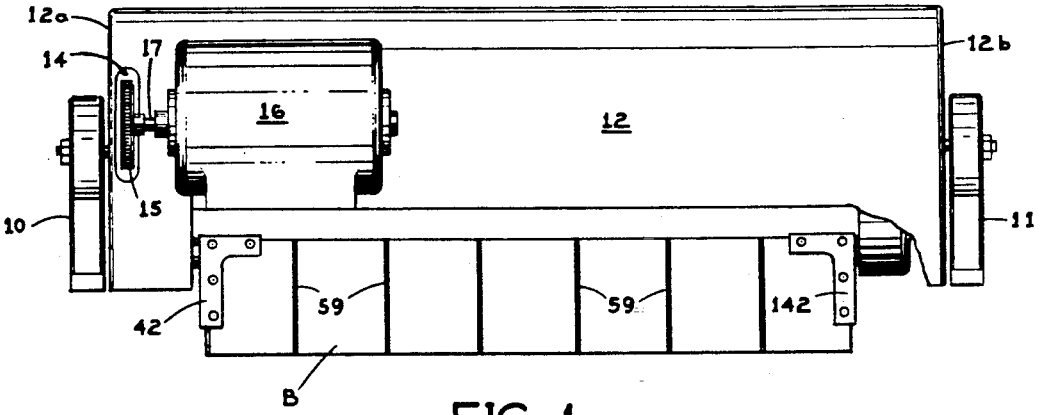
FIG. 1 is a front elevation of a paddlewheel apparatus in accordance with a first embodiment of the present invention.
Figure 2:
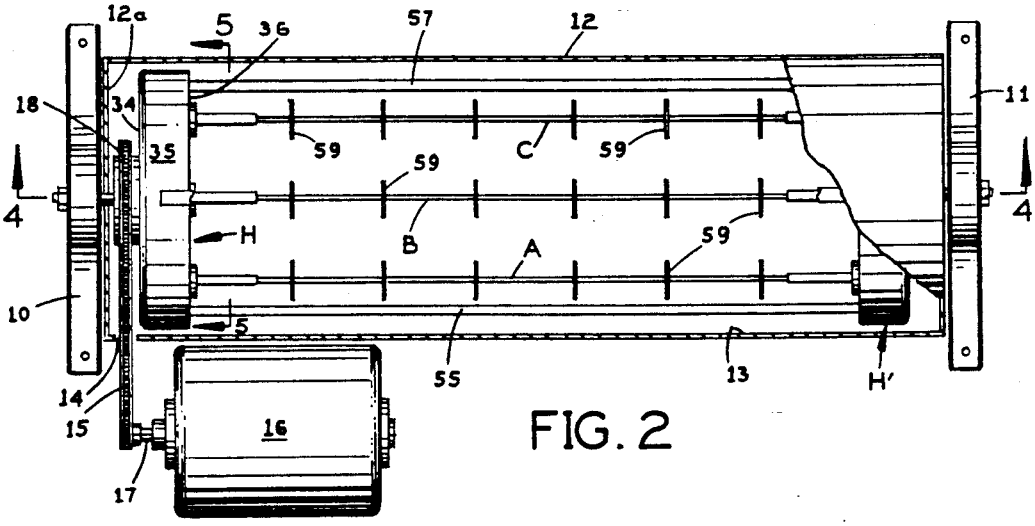
FIG. 2 is a top plan view of this apparatus with most of its housing broken away.
Figure 3:
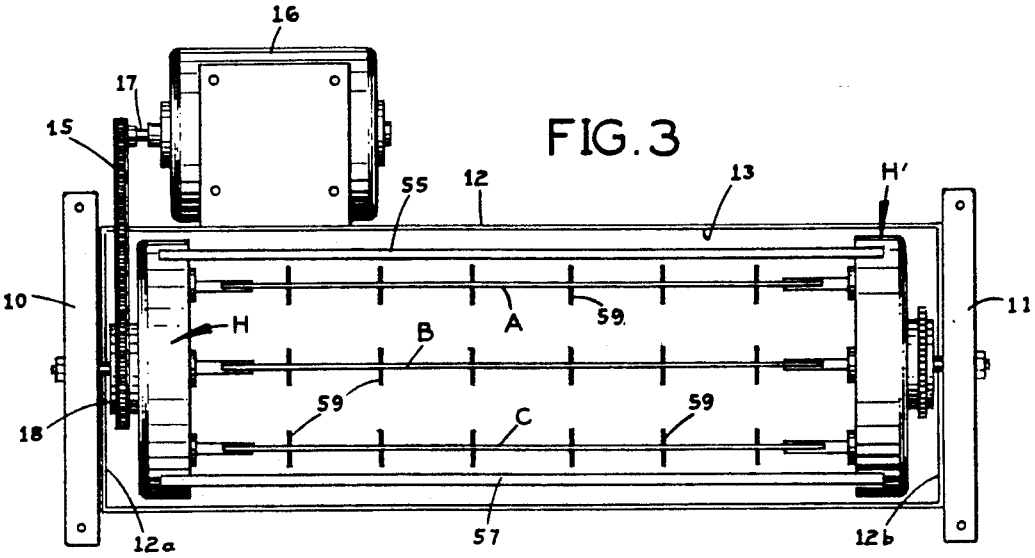
FIG. 3 is a bottom plan view of this apparatus.

Referring to FIG. 1, the present apparatus has fixedly mounted opposite end blocks 10 and 11 and a generally inverted U-shaped housing 12 extending between the end blocks. Housing 12 has flat opposite end walls **12*a* and 12*b* located a short distance in from the respective end blocks 10 and 11. Housing 12 provides a rectangular opening 13 (FIGS. 3 and 5) along the bottom. On the front (FIG. 1) housing 12 has an oblong opening 14 which passes a flexible endless drive chain 15 (FIG. 2) of conventional design. An electromotive force device 16, which may be either an electric motor or an electric generator, is mounted on the front of housing 12. EMF device 16 has a rotatable shaft 17 carrying a gear which engages the drive chain 15 at one end. Shaft 17 is the input shaft for the EMF device 16** if it is a generator and it is the output shaft if the EMF device is a motor.

Figure 4:
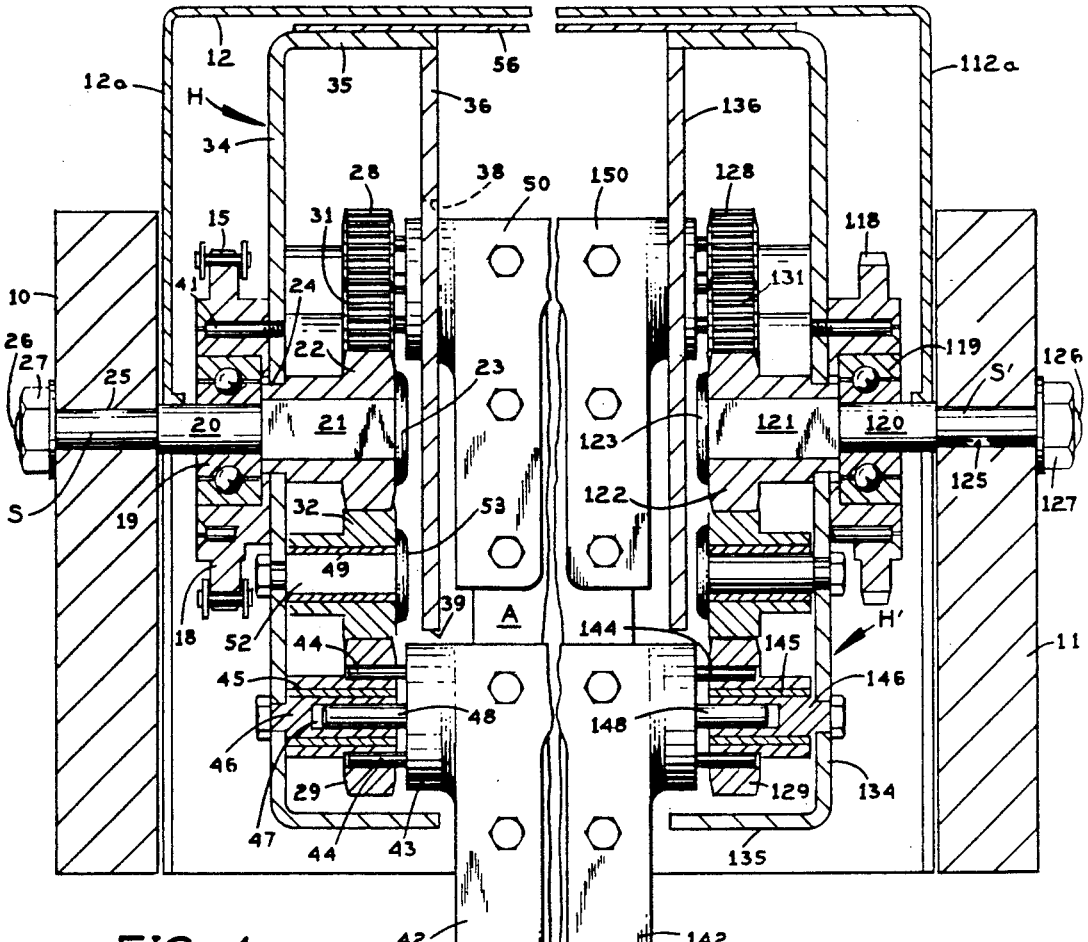
FIG. 4 is a vertical longitudinal section showing the opposite end portions of the apparatus along the line 4—4 in FIG. 2 at the central axis of the apparatus.

At its end away from the EMF device 16, chain 15 extends around and drivingly engages a gear 18 (FIGS. 2 and 4) located inside the housing 12 close to its end wall **12*a*. As shown in FIG. 4, gear 18 is mounted on a ball bearing 19 which encircles a cylindrical segment 20 of a fixed central shaft S. Therefore, gear 18 can rotate on shaft or hub S, and the axis of this shaft is the axis of rotation of gear 18**, which is a drive member in this paddlewheel apparatus.

Laterally inward from bearing 19, shaft or hub S has a segment 21 of rectangular cross-section on which a central sun gear 22 is snugly but slidably mounted. At its inner end shaft or hub S has an annular peripheral flange 23 which engages the inner end face of gear 22. Gear 22 has a reduced cylindrical segment 24 at its laterally outward end which engages the inner end of the inner race of bearing 19. Shaft or hub S extends snugly but slidably through an opening 25 in end block 10 and presents a screw threaded outer end segment 26 on which a flanged clamping nut 27 is threadedly mounted. Nut 27 is tightened to hold the flange 23 on the inner end of shaft or hub S tightly against gear 22, so that both shaft or hub S and sun gear 22 are fixedly positioned and cannot rotate. Gear 22 is the fixed sun gear in an epicyclic gear train of known design.

Three planet gears 28, 29 and 30 (FIG. 6) are arranged at equal intervals circumferentially around sun gear 22 and are coupled to the sun gear by respective idler gears 31, 32 and 33. Each planet gear 28, 29 and 30 is the same diameter and has the same number of teeth as the sun gear 22. FIG. 4 shows in detail how idler gear 32 is engaged between sun gear 22 and planet gear 29, meshing with both of them.

Figure 5:
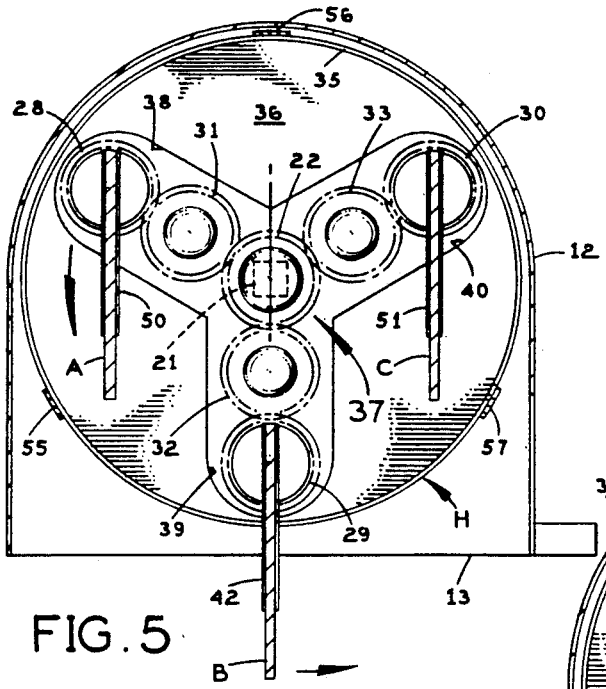
FIG. 5 is a vertical cross-section taken along the line 5—5 in FIG. 2.

The planet gears 28, 29 and 30 and the idler gears 31, 32 and 33 are rotatably mounted on a cylindrical holder H which has a generally Y-shaped opening 37 in its inner end wall, as shown in FIG. 5. As shown in FIG. 4, holder H is of two-piece construction. The outer piece of the holder has a flat, generally circular outer end wall 34 and a cylindrical peripheral wall 35 joined integrally to this end wall and extending perpendicularly inward from it. The inner piece 36 of holder H is a flat plate attached rigidly to the inside of peripheral wall 35 and extending from it parallel to the outer end wall 34. The inner piece 36 of holder H has the generally Y-shaped opening 37 (FIG. 5), the legs of which extend at 120 degree intervals, as shown at 38, 39 and 40 in FIG. 5. These legs of the Y-shaped opening are aligned respectively with planet gears 28, 29 and 30. Bolts 41 (FIG. 4) attach the drive gear 18 to the outside of the outer end wall 34 of housing H. Therefore, housing H and gear 18 rotate in unison.

As shown in FIG. 4, a bracket 42 on the upper end of a paddle B has a cylindrical projection 43 which is loosely received in leg 39 of the Y-shaped opening 37 in the inner piece 36 of the holder H. A plurality of pins 44 extend from bracket projection 43 into complementary openings in planet gear 29. Gear 29 is on a cylindrical anti-friction bushing 45 on a stem 46 that is clamped to the holder end wall 34. Stem 46 has a cylindrical socket 47 which snugly but slidably receives a centering pin 48 on bracket projection 43. The axis of planet gear 29 coincides with the axis of stem 46. With this arrangement, planet gear 29 can rotate with respect to stem 46 and bracket 42 moves in unison with gear 29.

FIGS. 4 and 5 show bracket 42 extending down through the bottom opening 13 in housing 12 and paddle B extending down from bracket 42.

A bracket 50 (FIG. 5) that is identical to bracket 42 is coupled in the same manner to planet gear 28, and a paddle A extends down from bracket 50.

Similarly, an identical bracket 51 (FIG. 5) is coupled in the same manner to planet gear 30 and a paddle C extends down from bracket 51.

The idler gear 32 that meshes with the stationary sun gear 22 and planet gear 29 in the epicyclic gear train is on a cylindrical anti-friction bushing 49 (FIG. 4). Bushing 49 is on a shaft or hub 52 that is clamped to the outer end wall 34 of holder H. A transverse flange 53 on the inner end of shaft 52 engages the inner end of bushing 49 and the inner end of gear 32. With this arrangement, gear 32 can rotate on shaft 52 as holder H turns.

Each of the other intermediate gears 31 and 33 is rotatably mounted on the holder in the same manner as gear 32.

As shown in FIG. 1, paddle B extends lengthwise from bracket 42 a short distance in from end block 10 to a similar bracket 142 a short distance in from the opposite end block 11. Bracket 142 is a mirror image of bracket 42. As shown in FIG. 4, bracket 142 is coupled to planet gear 129 in the same manner as already described in detail for bracket 42 and gear 29. Elements at the right end which correspond to the elements at the left end have the same reference numerals plus 100 and need not be described in detail. The rotatable holder at the right end is designated in its entirety as H' and the stationary shaft or hub there is designated as S'.

Between the holders H and H' each paddle A, B and C has a plurality of stiffening ribs 59 (FIG. 2) at intervals along its length. Each of these stiffening ribs extends perpendicular to the opposite major faces of the paddle and projects on opposite sides of the paddle.

An important feature of this invention is that there is no obstruction, such as an axle, below any of the three paddles A, B and C at any instant during each rotation of holders H and H'. For this reason each paddle may have a vertical dimension below the axis of its gear 28, 29 or 30 greater than the radial distance between the axis of the fixed central gear 22 and the axis of the planet gear to which that paddle is connected. The greater this vertical dimension of the paddle, the farther the paddle can enter the water in its lowermost position (as shown for paddle B in FIG. 5) and therefore the greater the power transfer from paddle to water or vice versa.

The holders H and H' at the opposite ends of the apparatus are connected by three longitudinal rigid straps 55, 56 and 57 removabley attached to each of them at 120 degree intervals circumferentially. These straps insure that the two holders rotate in unison. Each of these straps is midway between a corresponding pair of the planet gears 28, 29 and 30 so as not to obstruct the paddles A, B and C hanging down.

If desired the chain 15 may engage gear 118 at the right end instead of gear 18 at the left end. The EMF device will be located at the same end of the apparatus as the chain.

OPERATION

In the operation of the paddlewheel apparatus, as described, if EMF device 16 is a motor, it will rotate gear 18 through chain 15. Holder H rotates in unison with gear 18 and causes the planet gears 28, 29 and 30 to revolve circumferentially around the sun gear 22 (which does not rotate with gear 18 and holder H). Through the gear-toothed coupling between planet gears 28, 29 and 30 and sun gear 22 that is provided by idler gears 31, 32 and 33, the planet gears turn within the rotating holder H such that they always maintain the respective paddles A, B and C hanging down vertically. Holder H' at the opposite end rotates in unison with holder H, and the planet gears in the epicyclic gear train in holder H' also keep the paddles hanging down vertically.

Figure 7:
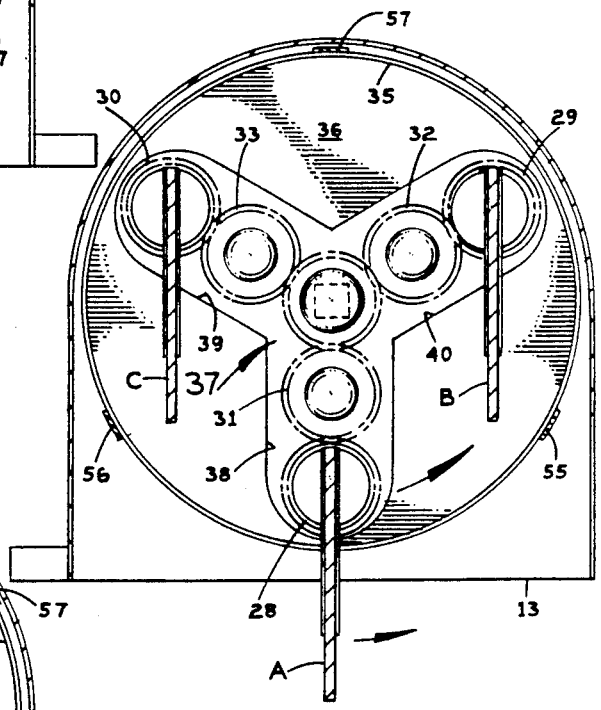
FIGS. 6 and 7 are views like FIG. 5 and showing the paddles in different positions around the central axis of the paddlewheel apparatus.
Figure 6:
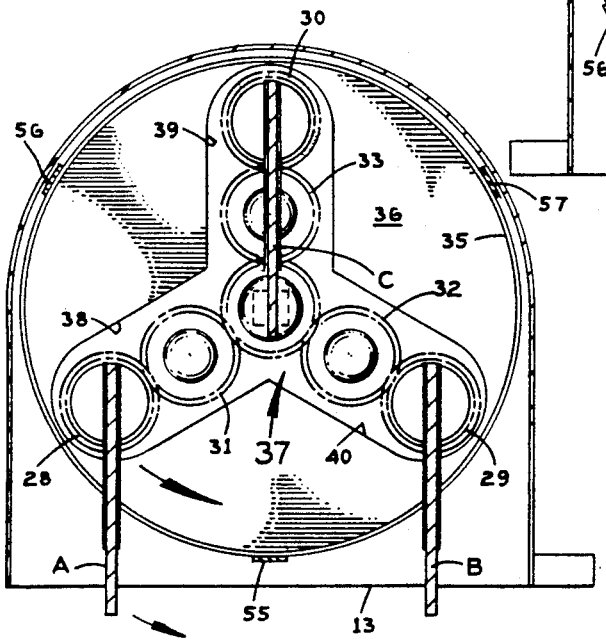

FIGS. 5, 6 and 7 show the positions of the parts at 60 degree intervals of counterclockwise rotation of holder H.

In FIG. 5 paddle B is in its lowermost position, hanging down through the bottom opening 13 in housing 12 vertically below the axis of shaft S (which is the rotational axis of holder H), and paddles A and C are on opposite sides of paddle B.

FIG. 6 shows the paddles 60 degrees counterclockwise from their positions in FIG. 5. Now paddles A and B extend down through the bottom opening 13 in housing 12 on opposite sides of the rotational axis of holder H, and paddle C hangs down vertically in its uppermost position.

FIG. 7 shows the paddles 60 degrees counterclockwise from their FIG. 6 positions. Now paddle A hangs down through the bottom opening 13 in housing 12, and paddles C and B are on opposite sides of paddle A.

Essentially the same action takes place in reverse if the EMF device is a generator and the motive power for the paddlewheel apparatus is from a fluid stream, such as water. For example, the paddlewheel may be on a boat moving through the water, in which case the relative movement between the water and the paddles causes the holder H to rotate. Another example is that tidal movement of water impinging on the paddles in succession and causing holder H to rotate.

FIGS. 8 AND 9

Figure 8:
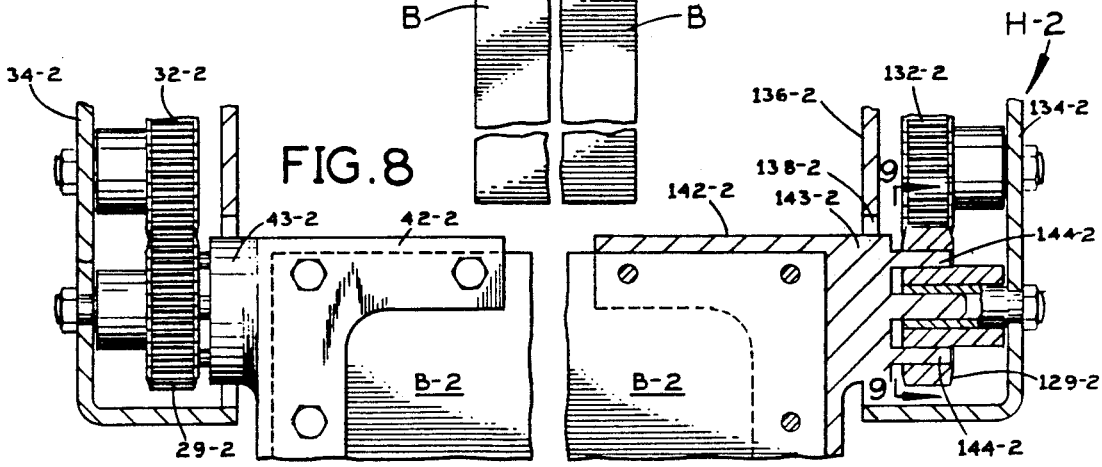
FIG. 8 is a view taken from the same position as FIG. 4 and showing a different arrangement for coupling each paddle to the corresponding planetary gear in the paddlewheel apparatus.
Figure 9:
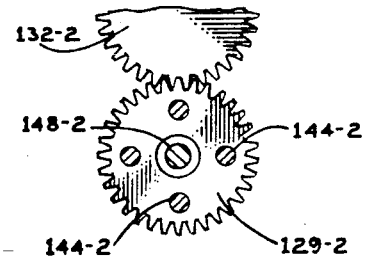
FIG. 9 is a fragmentary cross-section taken along the line 9—9 in FIG. 8 and showing one of the planet gears meshing with a corresponding idler gear.

FIGS. 8 and 9 show a second embodiment having a slightly different coupling between each planet gear and the corresponding paddle. Corresponding elements in these Figures have the same reference numerals as those in FIGS. 1-7 with a "−2" suffix added. It is unnecessary to repeat the detailed description of these corresponding elements.

On the right side in FIG. 8 the bracket 142-2 attached to the upper end of paddle B-2 has a laterally outwardly protruding head 143-2 extending through an opening 138-2 in the inner end wall 136-2 of a holder H-2 like Holder H in FIGS. 1-7. Solid cylindrical projections 144-2 extend from bracket head 143-2 into off-center openings in the corresponding planet gear 129-2.

FIGS. 10-15

A third embodiment of the invention is shown in FIGS. 10-15. Elements of this third embodiment which correspond to the elements of the first embodiment are given the same reference numerals with a "−3" suffix added. The detailed description of these corresponding elements will not be repeated.

This third embodiment has four paddles A, B, C and D at 90 degree intervals circumferentially around the longitudinal axis of the apparatus. At the left end in FIG. 11, paddle D has a lost-motion connection to a planet gear 60. An idler gear 61 is engaged between planet gear 60 and the central gear 22-3. At the right end of the apparatus, paddle D has a lost-motion connection to a planet gear 160 which is coupled to central gear 122-3 through an idler gear 161. Each paddle is symmetrical with respect to the rotational axis of the corresponding planet gear at each end, extending the same distance above and below that axis.

Figure 11:
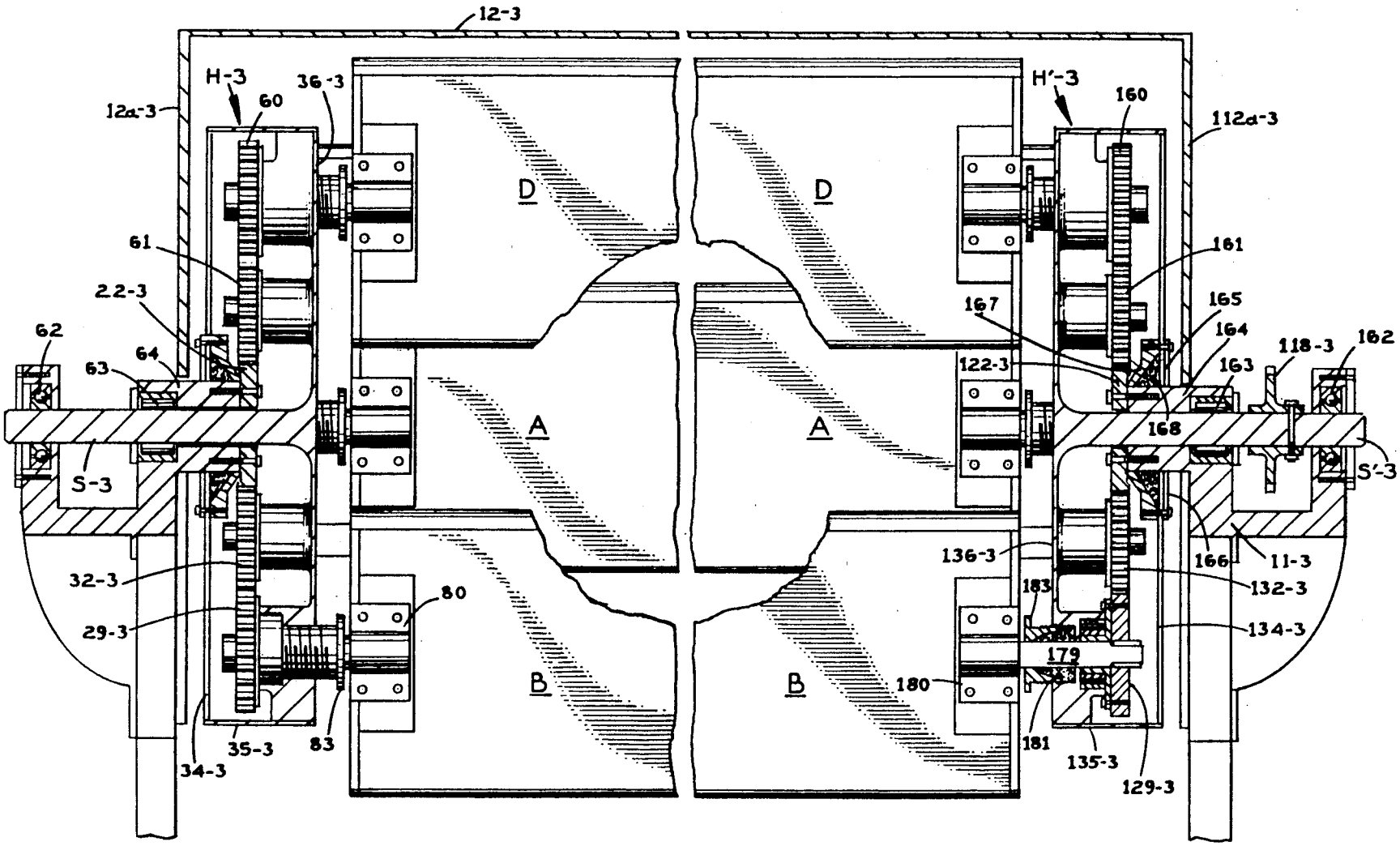
FIG. 11 is a longitudinal vertical sectional view of this third embodiment taken along the line 11—11 in FIG. 10.
Figure 13:
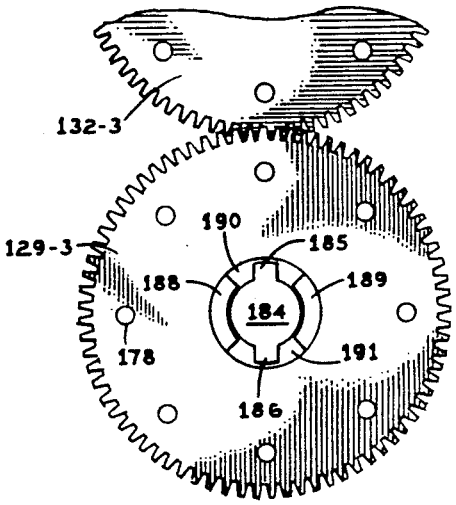
FIG. 13 is a fragmentary end elevation taken from the line 13—13 in FIG. 12.

At the right end in FIG. 11, a gear 118-3 is connected to holder H'-3 on the outside by being bolted to a horizontal shaft S'-3, the inner end of which is joined to the inner end wall 136-3 of holder H'-3 for the epicyclic gear train at this end of the apparatus. Shaft S'-3 is rotatably supported by anti-friction bearings 162 and 163 on opposite sides of gear 118-3. Gear 118-3 is the input gear if the paddlewheel apparatus is driven from a motor, and it is the output gear if the paddlewheel apparatus is driven by the water engaged by its paddles. Central gear 122-3 is bolted to a hub 164 on the upper end of the end block 11-3 at this end of the apparatus. This end block also supports bearings 162 and 163.

With this arrangement, rotation of the gear 118-3 (acting as an input drive gear) causes shaft 5'-3 and holder H'-3 to rotate in unison with it. The planet gears (e.g., 160 and 129-3) in holder H'-3 revolve about the axis of shaft S'-3 as holder H'-3 rotates.

Holder H'-3, in addition to its inner end wall 136-3, has a cylindrical peripheral wall 135-3 joined integrally to end wall 136-3 and a flat outer end wall 134-3 attached to peripheral wall 135-3. The outer end wall 134-3 of holder H'-3 has a circular central opening 165 which passes the hub 164 on end block 11-3 with a large clearance. A flat annular plate 166 on the outside of outer end wall 134-3 has a central opening which encircles hub 164 snugly but without interfering with the rotation of holder H'-3 on the hub. An annular fitting 167 on the inside of outer end wall 134-3 supports a fluid seal 168 which engages the hub 164 in water-tight fashion.

Each of the idler gears e.g., 132-3 and 161, at the right end of the paddlewheel apparatus is rotatably mounted in holder H'-3 in the manner shown in detail in FIG. 12 for idler gear 132-3. Holder H'-3 has an off-center hub 169 projecting from its inner end wall 136-3 toward its outer end wall 134-3. Hub 169 has an annular recess 170 which receives a needle bearing 171 that rotatably supports a flanged shaft member 172 to which the idler gear 132-3 is bolted.

Figure 14:
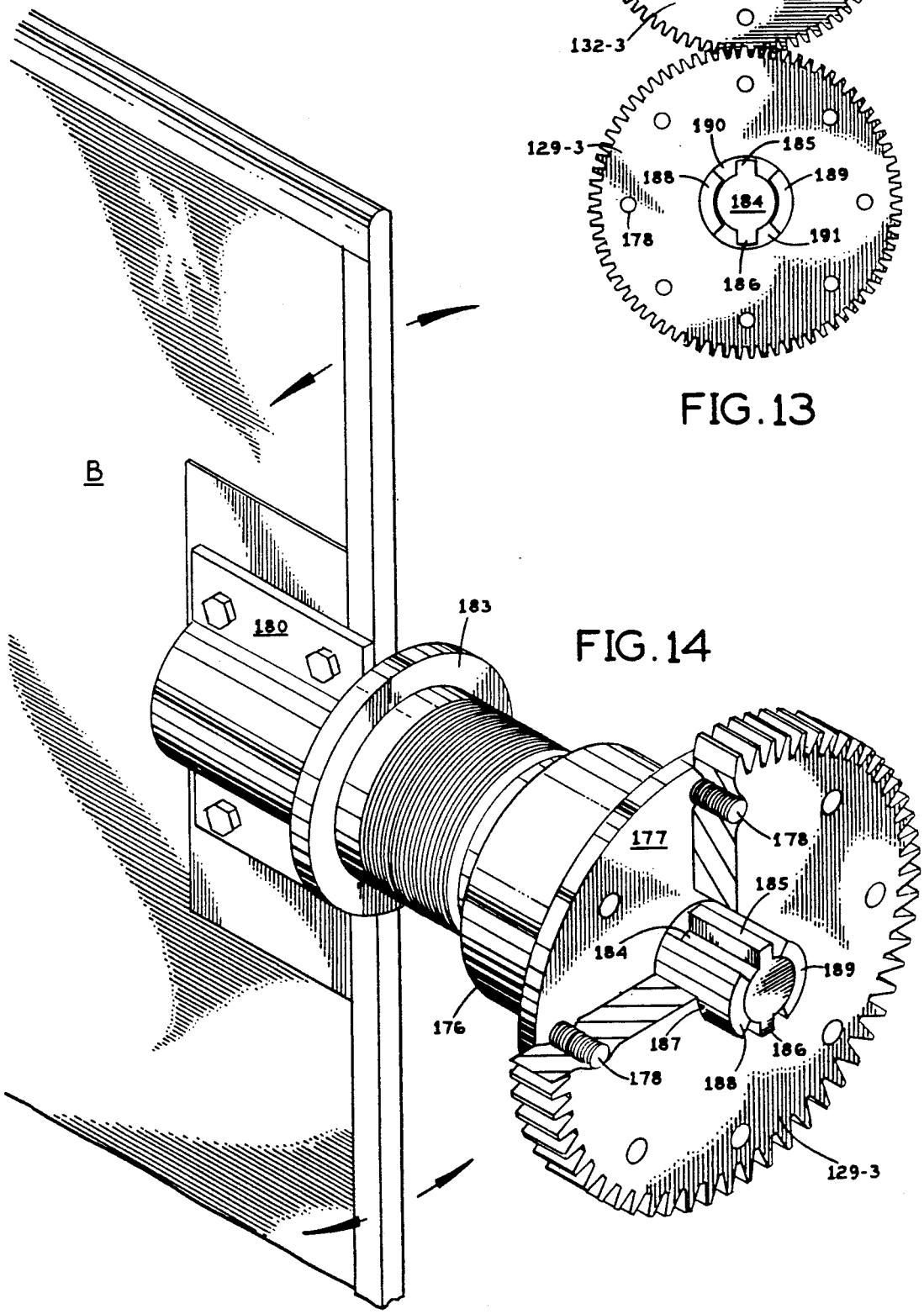
FIG. 14 is a perspective view, with parts broken away and other parts removed, showing the same lost-motion coupling as FIG. 12.

Each of the planet gears e.g., 129-3 and 160, at the right end of the apparatus is coupled to the corresponding paddle A, B, C or D in the manner shown in detail in FIG. 12 for planet gear 129-3 and paddle B. Holder H'-3 has an off-center segment 173 projecting from its inner end wall 136-3 toward its outer end wall 134-3. Segment 173 has an annular recess 174 which receives a needle bearing 175 that rotatably supports a flanged bushing 176 to which planet gear 129-3 is bolted. As shown in FIGS. 12 and 14, bushing 176 has a radially projecting annular flange 177 which is engaged by the inside face of planet gear 129-3 and is rigidly attached to this planet gear by bolts 178.

A horizontal shaft 179 is rigidly attached to paddle B by a bolted-on bracket 180 and extends outward from the paddle longitudinally of the paddlewheel apparatus. Shaft 179 passes through the inner end wall 136-3 and segment 173 of holder H'-3 and it is rotatably supported by the flanged bushing 176. A seal 181 engages shaft 179 in water-tight fashion at a recess 182 in holder H'-3 and inward beyond the inner end wall 136-3 of this holder. An annular retainer 183 for seal 181 is screw-threadedly received in holder H'-3 and holds the seal compressed against shaft 179 sufficiently to provide a water-tight seal around the shaft.

At its end away from paddle B, shaft 179 has a cutaway segment with a central core 184 of reduced cross-section and diametrically-opposed radial ribs 185 and 186 extending out from this core. Planet gear 129-3 has a central opening 187 (FIG. 14) in which a pair of arcuate segments 188 and 189 are press-fitted diametrically opposite one another. Arcuate segments 188 and 189 rotatably receive the reduced core 184 of shaft 179 and between them they define arcuate slots 190 and 191 (FIG. 13) which receive the outwardly projecting ribs 185 and 186 of the shaft. These arcuate slots are of substantially greater extent circumferentially of shaft 179 than the ribs 185 and 186 so as to provide a lost-motion coupling between paddle B and planet gear 129-3 when the paddle first encounters resistance. For example, in the case of a motor-driven paddlewheel apparatus, when the paddle B first enters the water this lost-motion coupling permits limited relative rotation between planet gear 129-3 and paddle B.

An identical lost-motion coupling is provided between each of the other paddles A, C and D and the corresponding planet gear 128-3, 130-3 and 160 at the right end of the paddlewheel apparatus.

At the left end of the apparatus in FIG. 11, there is an identical arrangement, the parts of which have the same reference numerals, minus 100, as the parts at the right end except that the central shaft is designated S-3 and the holder for the epicyclic gear train is designated H-3.

As shown in FIG. 10, the sun gear 22-3 at the left end of the paddlewheel apparatus is of two-piece construction, composed of similar halves on opposite sides of shaft S-3. This is also true of the sun gear 122-3 at the right end. This two-piece construction of each sun gear makes it easier to assemble on the corresponding shaft S-3 and S'-3 and to replace, when necessary. The holders at the opposite ends are connected by rigid straps 55-2, 56-2, 57-2 and 58-2 as in the other embodiment.

Figure 15:
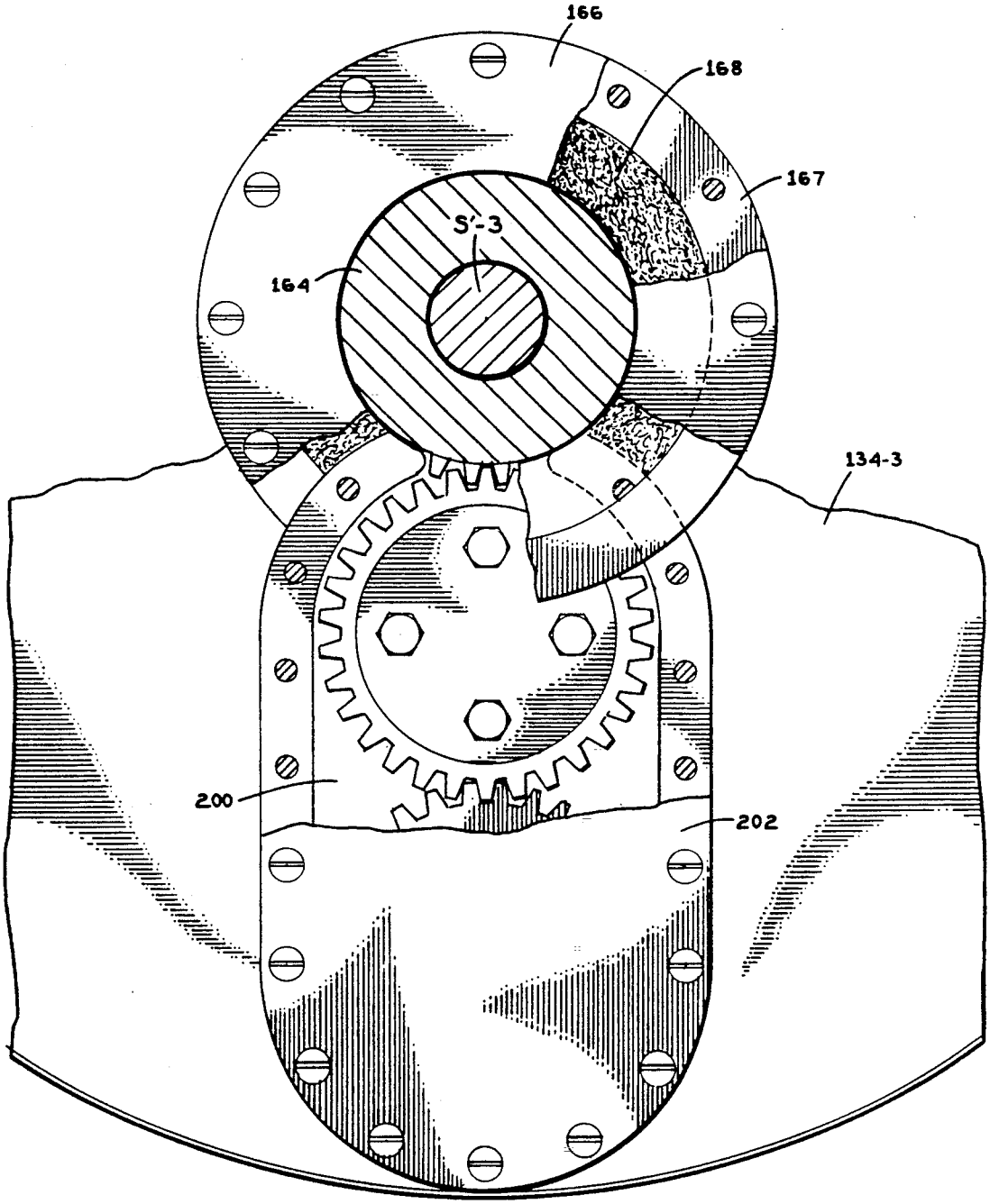
FIG. 15 shows covers on a holder.

As shown in FIG. 15, each holder has access openings 200, covered by covers 202, which are removable to allow access within the holders and say for maintenance purposes. These holder covers also serve to limit the distance of the outward thrust of gear shafts 172 and 184 thereby maintaining proper position of said shafts within their respective bearing enclosure.

I claim:

1. A paddlewheel apparatus comprising:

first and second fixed supports spaced apart along a predetermined axis;

first and second sun gears respectively supported from said first and second supports on said axis and held against rotation;

first and second holders rotatable on said axis and extending around said first and second sun gears respectively, said holders being interconnected to rotate in unison;

a drive member driveably connected to said first holder on the outside and rotatable in unison with said first holder;

a first set of additional gears forming a first epicyclic gear train with said first sun gear and rotatably mounted within said first holder, said first set of additional gears including planet gears spaced apart circumferentially around said first sun gear;

a second set of additional gears forming a second epicyclic gear train with said second sun gear and rotatably mounted within said second holder, said second set of additional gears including second planet gears spaced apart circumferentially around said second sun gear;

and a plurality of paddles located between said holders and each coupled at its opposite ends to a corresponding planet gear of aid first epicyclic gear train and to a corresponding planet gear of said second epicyclic gear train, each of said paddles hanging down substantially vertically and being unobstructed between said holders in all rotational positions of said holder.

2. A paddlewheel apparatus according to claim 1 wherein each of said epicyclic gear trains includes a plurality of idler gears, each in toothed engagement with the corresponding sun gear and a corresponding planet gear.

3. A paddlewheel apparatus according to claim 2 and further comprising:

a housing extending between said fixed supports said housing having opposite, substantially vertical, first and second end walls located laterally outward from said first and second holders, respectively, and an upper peripheral wall extending between said end walls around said holders and said paddles, said housing being open at the bottom below said upper peripheral wall to pass said paddles.

4. A paddlewheel apparatus according to claim 1 and further comprising:

a housing surrounding said first and second holders and said paddles except from below, said housing being open at the bottom to pass said paddles.

5. A paddlewheel apparatus according to claim 4 and further comprising:

a plurality of rigid straps connected to and extending between said first and second holders at circumferentially spaced locations around the outside of said paddles and inside said housing.

6. A paddlewheel apparatus according to claim 1 and further comprising:

a plurality of rigid straps connected to and extending between said first and second holders at circumferentially spaced locations around the outside of said paddles.

7. A paddlewheel apparatus according to claim 1 wherein each of said paddles is coupled at its opposite ends to said corresponding planet gears with substantially no rotational lost-motion between them.

8. A paddlewheel apparatus according to claim 1 and further comprising:

a lost-motion coupling between each of said paddles and said corresponding planet gears at its opposite ends, said lost-motion coupling permitting rotational lost-motion between each said paddle and said corresponding planet gears.

9. A paddlewheel apparatus according to claim 1 and further comprising:

a first central hub non-rotatably mounted in said first fixed support and extending therefrom into said first holder;

said first sun gear being non-rotatably mounted on said first central hub;

and a second central hub non-rotatabaly mounted in said second fixed support and extending therefrom into said second holder;

said second sun gear being non-rotatably mounted on said second central hub.

10. A paddlewheel apparatus according to claim 3 and further comprising:

a first central hub non-rotatably mounted in said first fixed support and extending therefrom into said first holder;

said first sun gear being non-rotatably mounted on said first central hub said drive member being rotatably mounted on said first central hub inside said housing;

and a second central hub non-rotatably mounted in said second fixed support and extending therefrom into said second holder;

said second sun gear being non-rotatably mounted on said second central hub.

11. A paddlewheel apparatus according to claim 10 wherein each of said paddles is coupled at its opposite ends to said corresponding planet gears with substantially no rotational lost-motion between them.

12. A paddlewheel apparatus according to claim 1 and further comprising:

a first central shaft rigidly connected to said first holder for rotation in unison therewith and extending from said first holder to said first support;

anti-friction bearing means rotatably supporting said first central shaft on said first support;

fastener means fixedly attaching said first sun gear to a first central hub;

a second central shaft rigidly connected to said second holder for rotation in unison therewith and extending from said second holder to said second support;

anti-friction bearing means rotatably supporting said second central shaft on said second support;

and fastener means fixedly attaching said second sun gear to a second central hub.

13. A paddlewheel apparatus according to claim 3 and further comprising:

a first central shaft rigidly connected to said first holder for rotation in unison therewith and extending from said first holder to said first support;

anti-friction bearing means rotatably supporting said first central shaft on said first support;

said drive member being affixed to said first central shaft outside said housing;

fastener means fixedly attaching said first sun gear to a first central hub;

a second central shaft rigidly connected to said second holder for rotation in unison therewith and extending from said second holder to said second support;

anti-friction bearing means rotatably supporting said second central shaft on said second support;

and fastener means fixedly attaching said second sun gear to a second central hub.

14. A paddlewheel apparatus according to claim 13 and further comprising:

a respective lost-motion coupling between each of said paddles and said corresponding planet gear at each of its opposite ends, said lost-motion coupling permitting rotational lost-motion between each said paddle and said corresponding planet gear.

15. A paddlewheel apparatus comprising:

first and second holders spaced apart along a predetermined axis and support members rotatably supporting said holders for rotation on said axis;

an epicyclic gear train in said first holder including a fixed sun gear coaxial with said axis and a plurality of planet gears spaced apart circumferentially around said sun gear, said planet gears being rotatably mounted in said first holder;

and a plurality of paddles respectively coupled at one end to said planet gears and extending substantially vertically down from said planet gears, said paddles extending between said holders and being substantially unobstructed between said holders.

16. A paddlewheel apparatus according to claim 15 and further comprising:

an additional epicyclic gear train in said second holder, said additional gear train including an additional fixed sun gear coaxial with said axis and a plurality of additional planet gears spaced apart circumferentially around said additional sun gear, said additional planet gears being rotatably mounted in said second holder, said additional planet gears being coupled to said paddles at the opposite end thereof.

* * * * *